United States Patent [19]

Cline

[11] Patent Number: 4,662,305

[45] Date of Patent: May 5, 1987

[54] COLLAPSIBLE SIGNPOST

[76] Inventor: Olin J. Cline, P.O. Box 547, Newcastle, Calif. 95658

[21] Appl. No.: 240,665

[22] Filed: Mar. 5, 1981

[51] Int. Cl.[4] ..... G09F 17/00

[52] U.S. Cl. ..... 116/173

[58] Field of Search ..... 40/607, 610; 116/173, 116/63 P, 63 R; 248/545, 156

[56] References Cited

U.S. PATENT DOCUMENTS

| | | | |
|---|---|---|---|
| 504,987 | 9/1893 | Marum | 116/173 |
| 3,138,886 | 6/1964 | Cobb | 40/607 |
| 3,200,786 | 8/1965 | Swezy | 40/610 |
| 3,381,763 | 5/1968 | Matson . | |
| 3,519,234 | 6/1970 | Matson . | |
| 4,249,715 | 2/1981 | Repp | 40/607 |

*Primary Examiner*—Harry N. Haroian

*Attorney, Agent, or Firm*—Townsend and Townsend

[57] ABSTRACT

A collapsible signpost comprising three major subassemblies is disclosed. An elongate support shaft having a ground engaging stake for engaging the ground mounted at the lower end thereof forms the main body of the signpost. An extendable arm having a mast head for supporting a display at the upper end thereof is received within an opening in the upper end of the support shaft. The arm may be extended upward from the support shaft and clip pin is provided to hold the arm at any of several desired elevations. A weighted cylinder is mounted on the support shaft and is free to reciprocate between flanges located at both the lower end and the upper end of the support shaft. By driving the cylinder against the lower flange, the ground-engaging stake is driven into the ground and by driving the cylinder against the upper flange, the ground-engaging stake is removed from the ground. A clip is provided to insert through holes in both the support shaft and extendable arm in such a manner that both the extendable arm and the cylinder are prevented from moving during transportation. A detachable support assembly may be provided to aid in displaying signs which are relatively large or comprised of fabric.

7 Claims, 6 Drawing Figures

COLLAPSIBLE SIGNPOST

BACKGROUND OF THE INVENTION

1. Field of the Invention

The present invention relates generally to posts for holding up signs, signal flags, and the like. More particularly, it relates to a collapsible highway sign having an integral driver for driving said signpost into the ground.

2. Description of the Prior Art

During highway construction and repair it is often necessary to place temporary signs and signal flags by the roadway to inform motorists of road conditions ahead. Most often, the signs and signal flags are supported on a temporary signpost which is inserted into the ground and supported thereby. It has been found desirable to provide such signposts with an integral driver for driving the signposts into the ground without use of additional equipment. Such a driver is described in the patent to Matson (U.S. Pat. No. 3,381,763) wherein a stake is provided with a weighted sleeve about the shaft of the stake. Upper and lower collars are provided on the shaft of the stake so that the stake may be driven into the ground by hammering the weighted sleeve against the lower collar. The stake may be removed from the ground by hammering the weighted sleeve against the upper collar. A similar concept is disclosed in the patent to Matson (U.S. Pat. No. 3,519,234). There, the main shaft of the signpost is a hollow cylinder which receives a piston and shaft through one end. Ground-penetrating blades are mounted on the shaft at the end opposite to that of the piston. By hammering the cylindrical body against an anvil or pad mounted on top of the blades, the stake may be driven into the ground. To remove the stake, the cylinder is driven against the piston located at the upper end of the shaft to apply an upward force on the blades.

It is desirable that signposts of the type described hereinabove be sufficiently long to support the display well above ground level. It is also desirable that the signposts be sufficiently short to facilitate transportation. The prior art disclosed hereinabove includes signposts of fixed length which must compromise between the aforesaid competing desires.

It is therefore an object of the present invention to provide a signpost which may be extended to any desired elevation and which may be collapsed into a compact configuration for transportation.

It is a further object of the present invention to provide a signpost in which the various elements thereof may be firmly secured for travel with minimum preparation.

SUMMARY OF THE INVENTION

The present invention overcomes the deficiencies of the prior art by providing a signpost having an extendable arm for supporting a display at a desired elevation above the ground. A means is provided for easily securing all the elements of said signpost in preparation for travel.

The present invention is a signpost comprising three subassemblies. The first subassembly is an elongate support shaft having ground-penetrating means at one end. A sleeve cylinder comprises the second subassembly and is mounted on the outside of the support shaft and is free to reciprocate thereon. By driving the sleeve cylinder against a lower flange mounted on the support shaft, the ground-engaging means may be driven into the ground. By driving the sleeve cylinder against an upper flange mounted on the support shaft, the ground-engaging means may be removed from the ground. The third subassembly is an extendable arm which is received within a hollow core of the support shaft. The arm extends upward from the support shaft to support a visual display at any elevation desired.

In one embodiment of the invention, the opening in the support shaft which receives the extendable arm is square. The extendable arm has a square cross section and, thus, the extendable arm is prevented from rotating within the support shaft because of the wind.

In another embodiment of the present invention, the support shaft and the extendable arm each have a transverse hole therethrough. The holes are located so that they are aligned when the extendable arm is in a fully retracted position. Furthermore, the holes are located a distance up from the lower flange slightly greater than the length of the sleeve cylinder. A clip is provided to penetrate the holes when they are in alignment whereby both the extendable arm and the sleeve cylinder are prevented from moving relative to the support shaft. In this way, the collapsible signpost may be safely transported with a minimum of preparation.

The signpost of the present invention may be provided with display support arms which are removably attached to the extendable arm and which enable the signpost to support large signs. The support arms may be folded and secured in preparation for traveling.

DESCRIPTION OF THE PREFERRED EMBODIMENT

Figure 1:
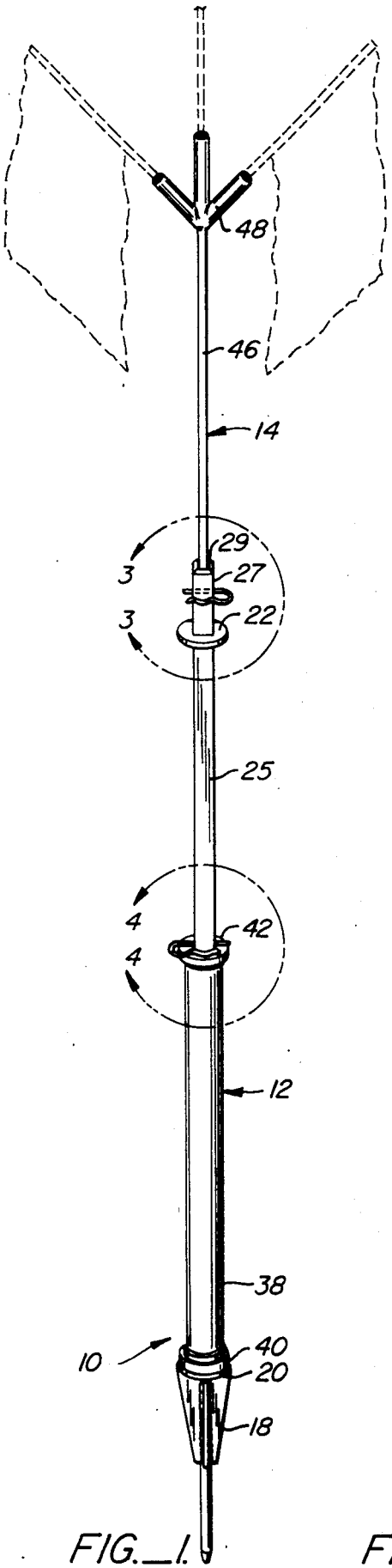
FIG. 1 is a perspective view of the present invention illustrating the extendable arm partially extended.

The collapsible signpost of the present invention comprises three separate subassemblies, an elongate support shaft 10, a sleeve cylinder 12, and an extendable arm 14.

The elongate support shaft includes a ground-engaging stake 18 at the lower end thereof for inserting into the ground and supporting the signpost in a vertical position. The terms upper and lower refer to the signpost as it would be oriented during use. That is, the ground-engaging stake 18 is at ground level and below the remainder of the signpost. A lower flange 20 is mounted on the support shaft 10 just above ground-engaging stake 18. The plane of the flange 20 is perpendicular to the longitudinal axis of the support shaft 10. An upper flange 22 is located near the upper end of the support shaft 10. The plane of the upper flange 22 is also perpendicular to the axis of the support shaft 10.

The shank 25 of the support shaft 10 is hollow and has a square cross section. The portion of the shank 25 above the upper flange 22 is reinforced by a facing 27. The facing 27 also has a square cross section and serves to hold the upper flange 22 in place when the sleeve cylinder 12 is driven thereagainst, as described hereinafter.

Figure 4:
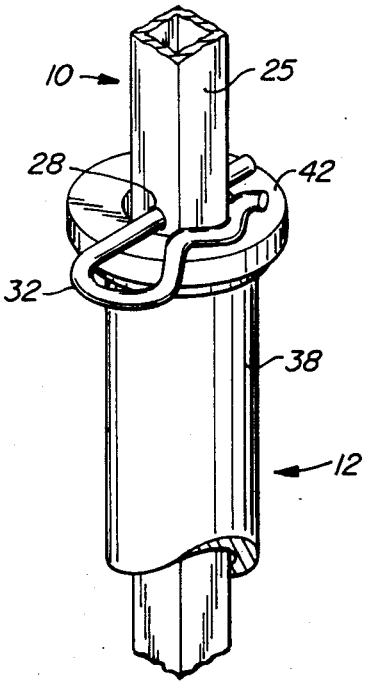
FIG. 4 is a detail view illustrating the portion of FIG. 1 embraced in circle 4—4.

The support shaft 10 has a hole 28 passing through both walls of the shank 25 and adapted to receive a clip 32 (FIG. 4). The hole 28 is located between the lower flange 20 and the upper flange 22 at a distance slightly greater than the length of the cylindrical sleeve 12 from said lower flange. By inserting the clip 32 in the hole 28 when the sleeve cylinder 12 is flush against the lower flange 20, said sleeve cylinder is prevented from moving.

Figure 3:
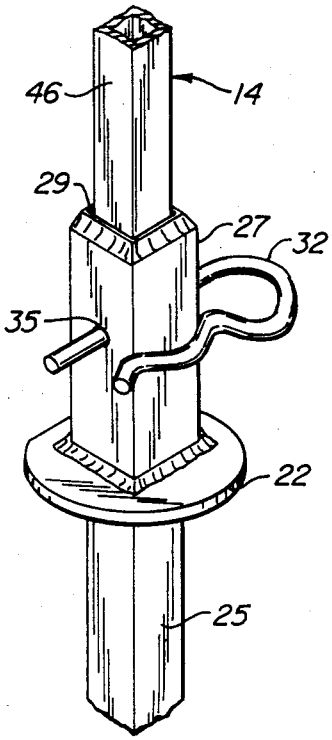
FIG. 3 is a detail view illustrating the portion of FIG. 1 embraced in circle 3—3.

A second hole 35 is found near the upper end of the support shaft 10 and penetrates both the support shaft and the facing 27. This hole 35 is illustrated in detail in FIG. 3. The hole 35 is also adapted to receive clip 32 and is used to hold the extendable arm 14 in an elevated position, as described hereinafter.

The sleeve cylinder 12 comprises a plane steel shank 38 having a lower end piece 40 and an upper end piece 42. The shank 38 has a hollow core adapted to receive the shank 25 of the support shaft 10. The core of the shank is circular and is sufficiently large to allow the cylindrical sleeve 12 to reciprocate freely along the shank 25 of the support shaft 10. The cylindrical sleeve 12 is mounted on the support shaft 10 between the upper and lower flanges 20, 22 and said flanges prevent the sleeve from being removed from the support shaft.

The cylindrical sleeve 12 has sufficient mass so that the ground-engaging stake 18 of the support shaft 10 may be driven into the ground by hammering the cylindrical sleeve against the lower flange 20. Since the lower flange 20 is mounted directly on the blades 28 of the ground-engaging stake 18, the force is transmitted directly to said ground-engaging stake and minimum damage is done to the signpost as a whole. As stated hereinabove, the cylindrical sleeve 12 may be held flush against the lower flange 20 by inserting clip 32 through hole 30. This will be done to prepare the signpost for traveling between use.

Figure 2:
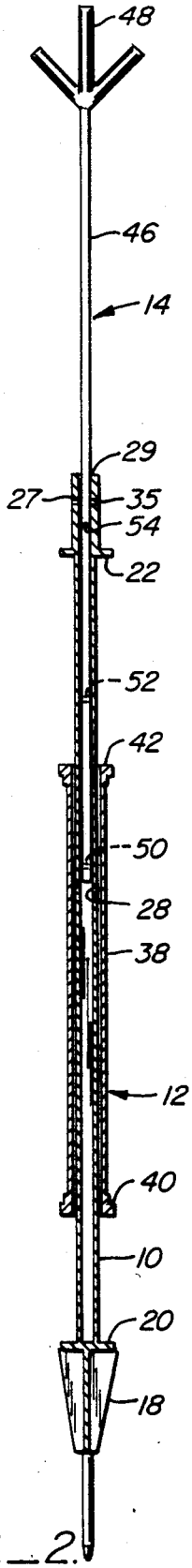
FIG. 2 is an elevation view illustrating the support shaft and the sleeve cylinder in cross section.

The extendable arm 14 is received through opening 29 in the support shaft 10. The extendable arm 14 includes a shank portion 46 and a masthead 48. The shank portion 46 has a square cross section and includes three holes 50, 52, 54 therethrough (FIG. 2). The hole 54 is located so that it will fall into alignment with hole 30 in the support shaft when the extendable arm 14 is fully retracted into said support shaft. Thus, by placing clip 32 through both holes 30 and 54, the sleeve cylinder 12 is maintained flush against the lower flange 20 and the extendable arm 14 is held in its fully retracted position. This important safety feature ensures that portions of the signpost will not become loose while the signpost is being moved. The simultaneous insertion of clip 32 through both the support shaft 10 and the extendable arm 14 is illustrated in FIG. 4 with the extendable arm 14 shown in phantom.

Holes 50 and 52 are used in conjunction with the hole 35 in the upper portion of the support shaft 12. When the signpost is inserted in the ground, the extendable arm 14 may be raised from its retracted position so that the display means may be elevated an additional distance above the roadway. When the arm 14 is elevated to a height where holes 52 and 35 are in alignment, clip 32 may be inserted to hold the arm at that elevation. Similarly, when holes 50 and 35 are in alignment, clip 32 may be inserted to fully extend arm 14.

It should be noted that the square cross section of the shank 46 of arm 14 and the square cross section of the opening 29 in the support shaft 12 together serve an important function. By preventing the extendable arm from rotating about its axis relative to the support shaft 12, it is ensured that alignment of the various holes may be achieved simply by adjusting the elevation of the extendable arm 14. Were the cross section of either the arm 14 or the opening 29 circular, relative rotation would be permitted and alignment of the holes would become more difficult.

Figure 5:
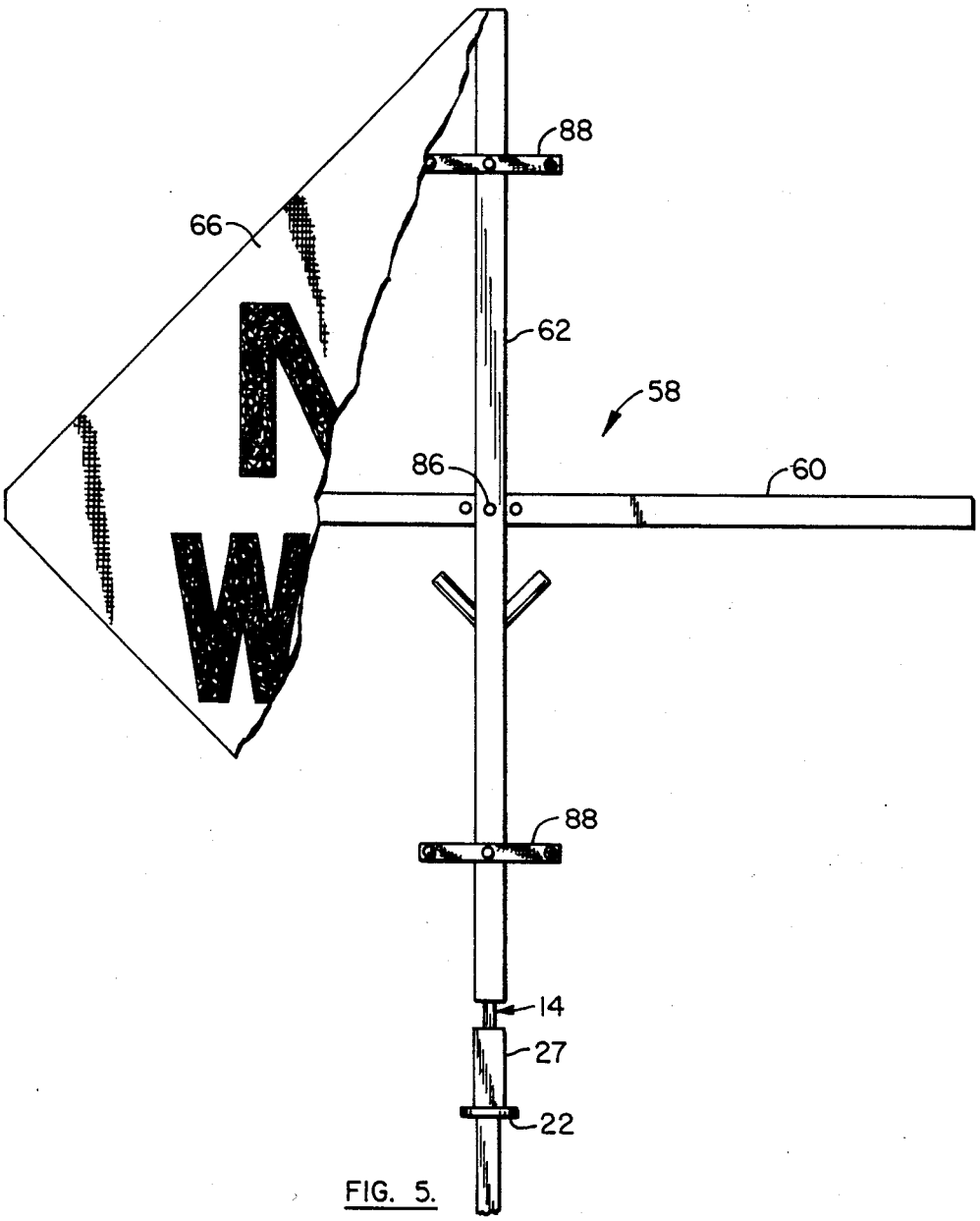
FIG. 5 is an elevated view of the display support arms of the present invention illustrating the manner of mounting on the extendable arm.
Figure 6:
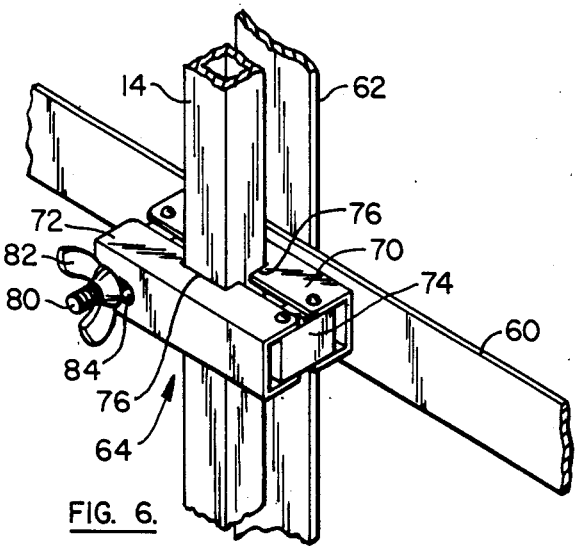
FIG. 6 is a detail view illustrating the attachment of the display support arms to the extendable arm.

Referring now to FIGS. 5 and 6, a display support assembly 58 comprising a horizontal support arm 60 and a vertical support arm 62 is illustrated. The support assembly 58 is attached to the extendable arm 14 of the signpost by a clamp 64 (FIG. 6) which is secured to the rear surface of the horizontal support arm 60. The front surfaces of both support arms 60, 62 are visible in FIG. 5 and are the surfaces upon which a sign, such as sign 66, partly illustrated in FIG. 5, will be mounted.

The clamp 64 includes a stationary bracket 70 which is secured directly to the horizontal support arm 60, a pivotable bracket 72 and a connecting member 74 which pivotally attaches the rear and front brackets. Both the front and the rear brackets 70, 72 have rectangular recesses 76 at their mid-sections which, when the brackets are facing each other as illustrated in FIG. 6, define a square hole adapted to receive the extendable arm 14 of the signpost. By tightening the brackets 70, 72 around the extendable arm 14 using bolt 80 and wing nut 82, the display support assembly 58 is secured to the signpost. The bolt 80 is secured to one end of the rear bracket 70 and is received in a slot 84 in the front bracket 72.

The support arms 60, 62 are attached by a pivot pin 86 and may be folded parallel to one another in preparation for moving or storage. Flexible ties 88 are provided to secure the arms 60, 62 in their folded position. Ties 88 are also to serve vertical support 62 to extended arm 14 while a sign is supported thereon.

Although the best mode contemplated for carrying out the present invention has been herein shown and described, it will be apparent that modification and variation may be made without departing from what is regarded to be the subject matter of the invention.

What is claimed is:

1. A signpost for supporting a display above ground, said signpost comprising:

an elongate support shaft including means for penetrating the ground at one end therof, a lower flange mounted generally at the one end of the shaft, and an upper flange mounted generally at the other end of the shaft, said support shaft being substantially hollow and having an opening at the other end thereof;

a sleeve cylinder having a central bore, said sleeve cylinder being slidably mounted on the support shaft so that it is free to reciprocate between the upper and lower flanges, wherein the support shaft has a transverse hole therethrough located above the lower flange in a direction toward the upper flange and at a distance from the lower flange substantially equal to the length of the sleeve cylinder;

an extendable arm having means for supporting the display at one end thereof, said extendable arm being received through the opening in the support shaft, wherein the extendable arm has a hole therethrough located so that said hole in the extendable arm is in alignment with the hole through the support shaft when the arm is fully received in the hollow of the shaft;

a clip which may be inserted simultaneously through both holes when the arm is fully received in the shaft and when the sleeve cylinder is disposed against the lower flange, whereby both the arm and the sleeve cylinder are held in place relative to the support shaft so that the signpost may be safely moved from place to place; and means for selectively securing the extendable arm at at least three different positions within the support shaft corresponding to different elevations of the display above the ground.

2. A signpost as in claims 1, wherein the opening in the support shaft has the shape of a polygon and wherein the extendable arm has a cross-section shaped as a similar polygon, whereby the extendable arm is prevented from rotating within the support shaft.

3. A signpost as in claim 2, wherein the polygon is a square.

4. A signpost as in claim 1, further including a means for supporting a relatively large display, said means being removably attached to the extendable arm.

5. A signpost as in claim 5, wherein said means for supporting a relatively large display comprises a first support arm, a second support arm pivotally attached to said first support arm, and a clamp attached to said first support arm for securing said means for supporting to the extendable arm.

6. A signpost as in claim 5, wherein said clamp has an opening in the shape of a polygon and wherein the extendable arm has a cross-section in the shape of a similar polygon, said opening receiving said extendable arm therein, whereby the means for supporting is prevented from rotating about the axis of the extendable arm.

7. An improved signpost for supporting a display above the ground, said signpost including an elongate support shaft having a hollow core and ground-penetrating means mounted on the lower end thereof, an upper flange and a lower flange mounted on said support shaft, and a sleeve cylinder reciprocably mounted on said support shaft between said upper flange and said lower flange, the improvement comprising:

an extendable arm having means for supporting the display at one end thereof, said extendable arm being received in the hollow core of the support shaft and being capable of extending upward therefrom, said extendable arm having a plurality of transverse holes therethrough; and a clip;

wherein the support shaft has a first transverse hole therethrough located near the upper end thereof and a second transverse hole located above the lower flange at a distance substantially equal to the length of the sleeve cylinder, whereby the extendable arm may be supported in an extended position by aligning the first hole through the support shaft with particular ones of the holes in the extendable arm and inserting the clip through both holes simultaneously, and whereby both the extendable arm and the sleeve cylinder may be secured relative to the support shaft by aligning the second hole in the support shaft with a particular one of the holes in the extendable arm and inserting the clip through both holes simultaneously.

* * * * *